US007496317B2

(12) United States Patent
Igarashi et al.

(10) Patent No.: US 7,496,317 B2
(45) Date of Patent: Feb. 24, 2009

(54) IMAGE-FORMING DEVICE FACILITATING RESOLUTION OF PAPER JAM

(75) Inventors: Hiroshi Igarashi, Nagoya (JP); Tsugio Okamoto, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 147 days.

(21) Appl. No.: 11/513,134

(22) Filed: Aug. 31, 2006

(65) Prior Publication Data

US 2007/0048006 A1 Mar. 1, 2007

(30) Foreign Application Priority Data

Aug. 31, 2005 (JP) ..... 2005-252780
Sep. 26, 2005 (JP) ..... 2005-277899

(51) Int. Cl.
*G03G 21/00* (2006.01)

(52) U.S. Cl. ..... 399/124; 399/98

(58) Field of Classification Search ..... 399/98, 399/110, 121, 124, 125
See application file for complete search history.

(56) References Cited

U.S. PATENT DOCUMENTS 5,652,942 A 7/1997 Iseki et al.
5,787,326 A * 7/1998 Ogawa et al. ..... 399/124
5,839,032 A * 11/1998 Yasui et al. ..... 399/124
5,887,228 A * 3/1999 Motohashi et al. ..... 399/121 X
5,897,244 A * 4/1999 Miyazaki et al. ..... 399/124 X
6,219,505 B1 4/2001 Sato et al.
6,415,119 B2 7/2002 Nishimura et al.
6,505,019 B2 1/2003 Sato et al.
6,708,009 B2 3/2004 Fuwazaki et al.
6,708,011 B2 3/2004 Nomura et al.
6,801,742 B1 * 10/2004 Mochimaru et al. ..... 399/124 X
7,149,456 B2 * 12/2006 Yamagata ..... 399/98
2001/0026705 A1 10/2001 Sato et al.

FOREIGN PATENT DOCUMENTS

JP 5-066623 3/1993
JP 7-112848 5/1995
JP 8-286445 11/1996
JP 11-349170 12/1999
JP 2000-172151 6/2000
JP 2003-081477 3/2003
JP 2003-107838 4/2003

* cited by examiner

*Primary Examiner*—Sandra L Brase
(74) *Attorney, Agent, or Firm*—Banner & Witcoff, Ltd.

(57) ABSTRACT

A feeding unit is disposed near the lower edge of an access opening formed in a front cover of a main casing. The feeding unit includes a pair of registration rollers and a pair of guide parts. One of the registration rollers and one of the guide parts are retained on the front cover. Thus, when the front cover is pulled to an open position, the registration roller and the guide part retained on the front cover displace together with the front cover, exposing a paper conveying path.

20 Claims, 11 Drawing Sheets

IMAGE-FORMING DEVICE FACILITATING RESOLUTION OF PAPER JAM

CROSS REFERENCE TO RELATED APPLICATIONS

This application claims priority from Japanese Patent Application Nos. 2005-252780 and 2005-277899 filed Aug. 31, 2005 and Sep. 26, 2005, respectively. The entire content of each of these priority applications is incorporated herein by reference.

TECHNICAL FIELD

The disclosure relates to an image-forming device, and particularly to a tandem-type image-forming device having a pullout section that can be removed from the image-forming device.

BACKGROUND

There has been known a tandem-type color laser printer as an electrophotographic type image forming device. This type of laser printer commonly includes a process unit disposed inside a main casing. The process unit includes a plurality of image forming units, each of which includes a photosensitive drum, a developing device, a charger, and the like.

In one such image-forming device disclosed in Japanese Unexamined Patent-Application Publication No. 2003-107838, developing units and other components in the image-forming units can be replaced by opening a cover provided on the front surface of the main casing and pulling the process unit out of the main casing through an opening formed in the front side thereof. This type of image-forming device may also include a conveying belt for conveying a recording medium, such as paper, below the process unit and past each of the image-forming units in the process unit, and a feeding unit disposed to the front of the conveying belt near the lower edge of the opening in the front of the main casing for supplying paper fed from a paper tray onto the top surface of the conveying belt. As one example, the feeding unit may include a pair of guide parts disposed one on either side of a paper-conveying path and having opposing arc-shaped surfaces, and a pair of conveying rollers for pinching and conveying the paper.

With this construction, it is effective to configure the feeding unit so that a portion of the feeding unit, such as one of the guide parts, one of the conveying rollers, and the like, can be moved relative to the opposing guide part and the opposing conveying roller in order to temporarily open a portion of the paper-conveying path to facilitate the resolution of paper jams. However, it is necessary to prevent a conflict between the movable portion of the feeding unit and the process unit when the process unit is removed. Therefore, it is necessary to provide clearance for removing the process unit from the main casing, which may lead to an increased overall size of the image-forming device.

Further, in an image-forming device, paper is interposed between a feeding roller and a separating pad to ensure that the paper is separated and fed one sheet at a time. The friction generated with the separating pad tends to deposit paper dust and the like on the paper. If these deposits become mixed with the toner and deposited in the image formed on the paper, the quality of the formed images will degrade.

Therefore, an image-forming device disclosed in Japanese Unexamined Patent-Application Publication No. 2003-81477 provides an electrically charged deposition-removing roller on the paper-conveying path. The deposition-removing roller rotates and attracts matter deposited on the paper. Subsequently, a scraping member formed of sponge or the like and disposed in contact with the deposition-removing roller scrapes the deposited matter off the deposition-removing roller. The deposited matter scraped off by the scraping member is collected in a deposition-collecting vessel.

With this type of image-forming device, it is necessary to temporarily open a cover on the main casing when paper becomes jammed during an image-forming operation in order to resolve the paper jam. However, with the existence of the deposition-removing roller in the main casing, there is potential for the deposition-removing roller to interfere with the operation for resolving paper jams.

SUMMARY

In view of the foregoing, it is an object of the invention to provide an image-forming device capable of facilitating an operation for resolving a paper jam, while not necessitating an increase in size of the device.

In order to attain the above and other objects, according to one aspect, the invention provides an image-forming device including a main casing having a surface formed with an opening, a process unit having a plurality of image-forming units that forms images on a recording medium, the process unit being horizontally attachable to and detachable from the main casing through the opening, a conveying belt that is disposed below the process unit and conveys the recording medium, a feeding unit that is disposed between the opening and the conveying belt and includes a first part and a second part opposing the first part, the feeding unit feeding the recording medium between the first part and the second part onto the conveying belt, and a cover capable of opening and closing over the opening. The first part of the feeding unit is displaceable together with the cover. An upper edge of the cover in an open state is positioned lower than an upper end of the second part of the feeding unit.

According to a different aspect, there is also provided an image-forming device including a main casing having a surface formed with an opening, a cover capable of opening and closing over the opening, a deposition removing unit that is disposed on the cover and removes matter deposited on a recording medium, and a deposition collecting unit that is disposed inside the main casing and collects the matter removed by the deposition removing unit.

BRIEF DESCRIPTION OF THE DRAWINGS

Illustrative aspects in accordance with the invention will be described in detail with reference to the following figures wherein.

DETAILED DESCRIPTION

Figure 1:
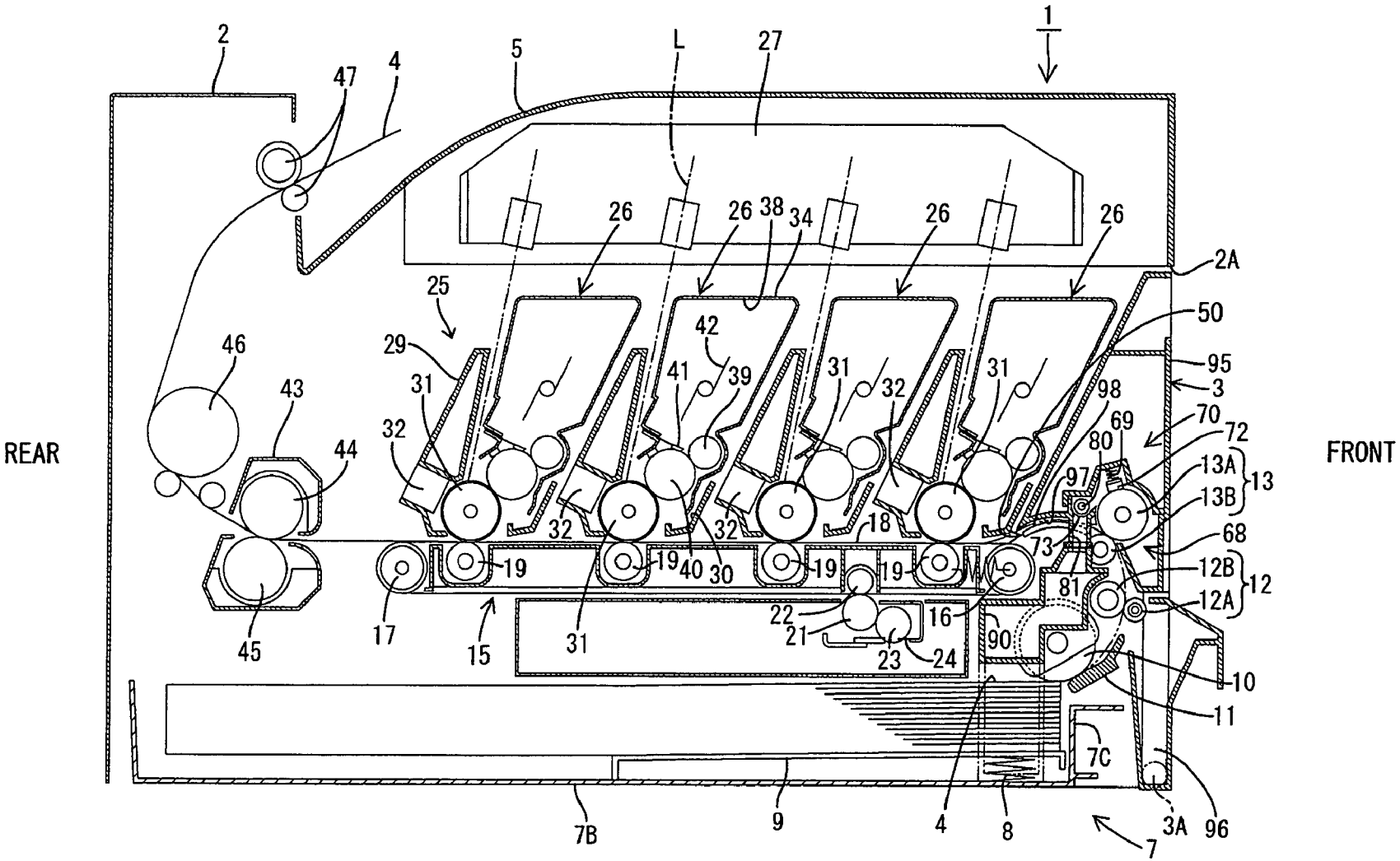
FIG. 1 is a side cross-sectional view showing the general structure of a laser printer according to first illustrative aspects of the invention.

An image-forming device according to some aspects of the invention will be described while referring to the accompanying drawings wherein like parts and components are designated by the same reference numerals to avoid duplicating description.

First, a laser printer 1 as an image-forming device according to first illustrative aspects of the invention will be described with reference to FIGS. 1 to 8. In the following description, the right side in FIG. 1 will be referred to as the "front side" of the laser printer 1.

The laser printer 1 shown in FIG. 1 is a color laser printer having a direct transfer tandem system. As shown in FIG. 1, the laser printer 1 includes a box-shaped main casing 2 formed with an access opening 2A in the front surface thereof. A front cover 3 is attached to the main casing 2 for covering and exposing the-access opening 2A.

A discharge tray 5 is formed on the top of the main casing 2 for supporting a stack of sheets of paper 4 that have been formed with images.

A sheet supply cassette 7 is disposed in the lower section of the main casing 2. The sheet supply cassette 7 can be detached from the main casing 2 by being pulled toward the front.

The sheet supply cassette 7 has an open-top box shape, providing a sheet accommodate space 7B therein. A pressing plate 9 is disposed inside the sheet accommodate space 7B for supporting a stack of sheets of paper 4. The pressing plate 9 is pivotable to lift up the front end of the paper 4 due to urging force of a spring 8. A pickup roller 10 and a separating pad 11 are disposed above a front end 7C of the sheet accommodate space 7B. A spring (not shown) urges the separating pad 11 against the pickup roller 10.

A pair of sheet supply rollers 12 (12A, 12B) is disposed diagonally above and frontward of the pickup roller 10. The sheet supply roller 12A is disposed to the front of the sheet supply roller 12B. A pair of registration rollers 13 (13A, 13B) is disposed above the pair of sheet supply rollers 12. As will be described later, the registration roller 13A also serves as a paper dust removing roller.

Figure 3:
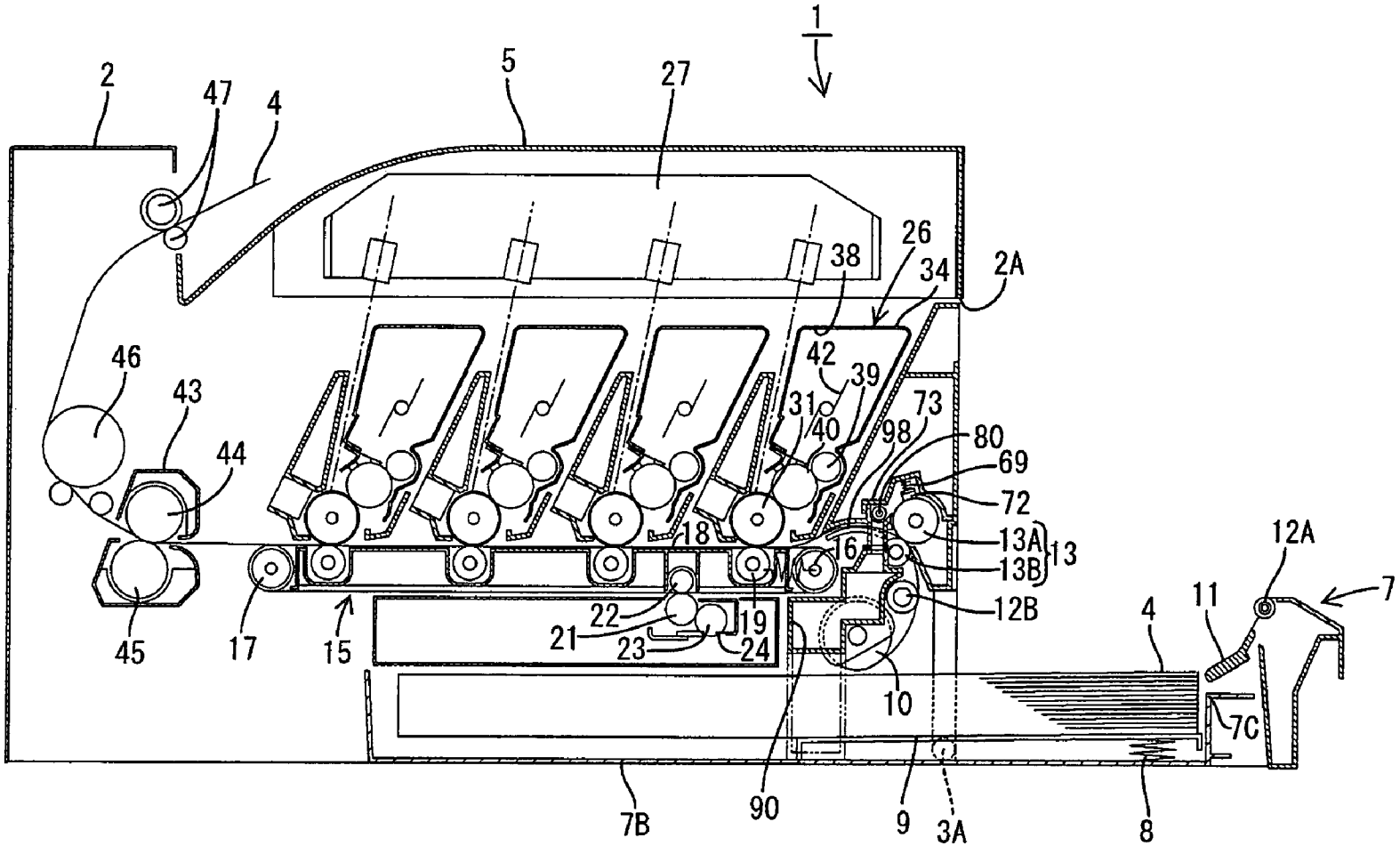
FIG. 3 is a side cross-sectional view showing the laser printer of FIG. 1 when a sheet supply cassette is being removed.

The sheet supply roller 12A and the separating pad 11 are supported on the sheet supply cassette 7. Therefore, when the sheet supply cassette 7 is pulled out of the main casing 2, as shown in FIG. 3, the sheet supply roller 12A and the separating pad 11 are also pulled out together with the sheet supply cassette 7.

With this configuration, when a paper jam occurs near the pickup roller 10 or the sheet supply rollers 12, a jammed paper can be easily removed by pulling the sheet supply cassette 7 out of the main casing 2.

As shown in FIG. 1, a top-most sheet of paper 4 on the pressing plate 9 is urged toward the pickup roller 10. Rotation of the pickup roller 10 brings the paper 4 to a position between the pickup roller 10 and the separating pad 11, and a single sheet of paper 4 is separated from the stack at one time. The sheet of paper 4 supplied by the pickup roller 10 and the separating pad 11 is conveyed to the registration rollers 13 by the sheet supply rollers 12. The registration rollers 13 perform a registration operation on the paper 4 at a proper timing and then convey the paper 4 to a belt unit 15 disposed to the rear of the registration rollers 13.

Figure 2:
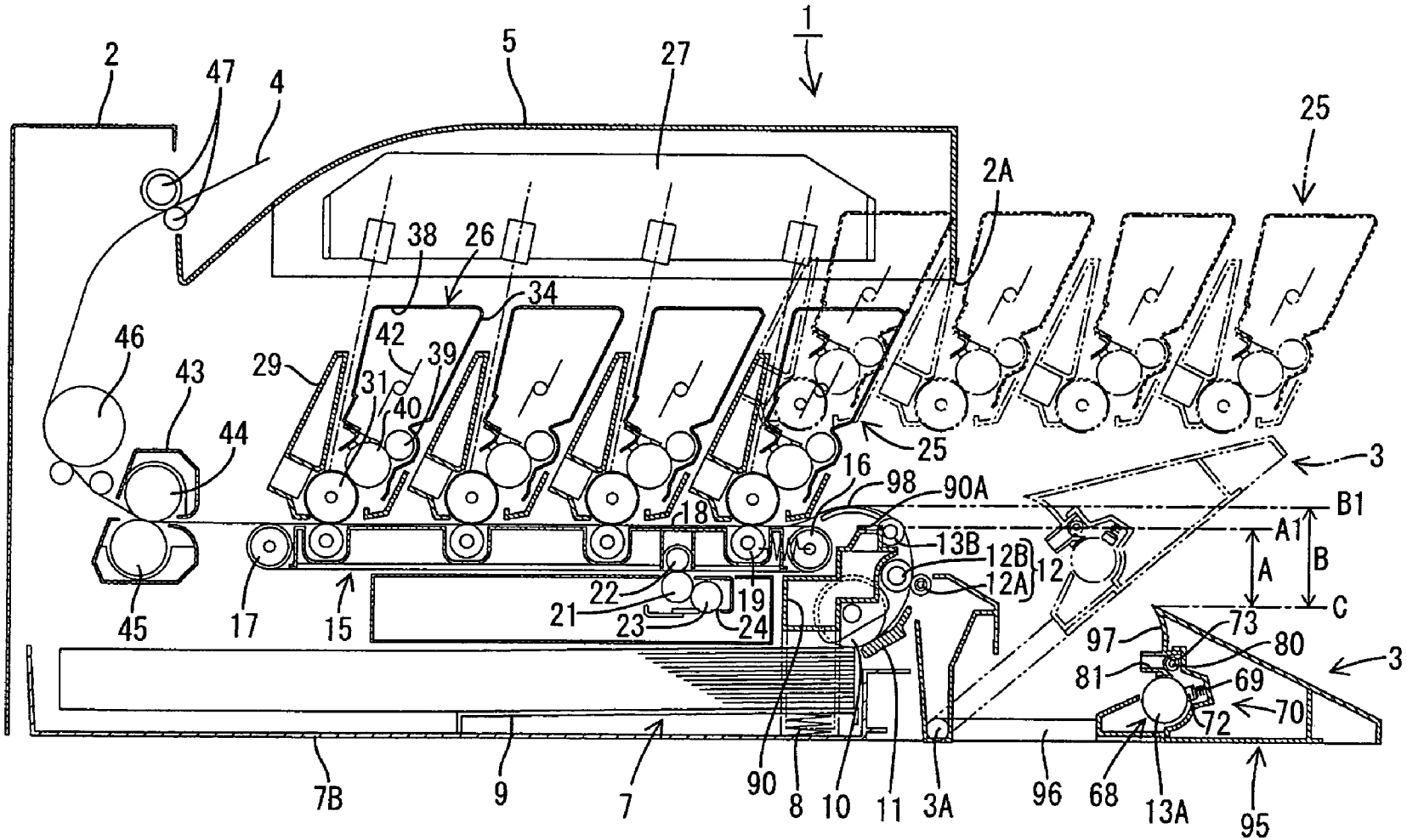
FIG. 2 is a side cross-sectional view showing the laser printer in FIG. 1 when a front cover is open.

The main casing 2 is formed integrally with a main-casing-side guide part 98 near the bottom edge of the access opening 2A. As shown in FIG. 2, the main-casing-side guide part 98 is formed to project to a height B1 greater than a height A1 to the top surface of a conveying belt 18 described later and has an arc-shaped surface with the highest point of the arc on top. The main-casing-side guide part 98 functions to guide the paper 4 to a paper-conveying path on the top of the belt unit 15 positioned slightly lower than the main-casing-side guide part 98.

As shown in FIG. 1, a scanner unit 27 is fixed in the upper section of the main casing 2 and emits laser lights L for respective colors based on prescribed image data. The laser lights L irradiate, in a high speed scanning operation, the surfaces of corresponding photosensitive drums 31 to be described later.

A process unit 25 is disposed below the scanner unit 27 and inward of the access opening 2A. The process unit 25 includes four process cartridges 26, each corresponding to toner for one of four colors magenta, yellow, cyan, and black. Each process cartridge 26 includes the photosensitive drum 31, a Scorotron charger 32, and a developing cartridge 34.

The process unit 25 also includes a frame 29 that has four cartridge frames 30 arranged in a front-to-rear direction. Each cartridge frame 30 is open on the top and bottom and functions to receive the corresponding developing cartridge 34 mounted therein. The photosensitive drum 31 is retained at a position on the lower edge of the cartridge frame 30, and the charger 32 is retained adjacent to the photosensitive drum 31.

The photosensitive drum 31 includes a metal main drum that is grounded. The surface of the main drum is coated with a positively charging photosensitive layer formed of polycarbonate or the like.

The charger 32 is disposed in confrontation with the photosensitive drum 31 at a position diagonally above and rearward of the photosensitive drum 31. The charger 32 is spaced away from the photosensitive drum 31 so as to avoid direct contact with the photosensitive drum 31. The charger 32 generates a corona discharge from a charging wire, such as a tungsten wire, for example, thereby applying a uniform charge of positive polarity across the entire surface of the photosensitive drum 31.

Each developing cartridge 34 has a substantially box shape, and a toner accommodating chamber 38 is formed in the upper section of the developing cartridge 34. The toner accommodating chamber 38 is filled with positive charging non-magnetic, single component toner for corresponding one of four colors yellow, magenta, cyan, and black. An agitator 42 for agitating the toner is disposed inside the toner accommodating chamber 38. The developing cartridge 34 further includes a supply roller 39, a developing roller 40, and a thickness regulating blade 41, all disposed below the toner accommodating chamber 38.

The supply roller 39 includes a metal roller shaft covered with a conductive foam material, and the developing roller 40 includes a metal roller shaft coated with a conductive rubber material.

The toner discharged from the toner accommodating chamber 38 is supplied to the developing roller 40 by the rotation of the supply roller 39 and positively tribocharged between the supply roller 39 and the developing roller 40. In association with the rotation of the developing roller 40, the toner on the developing roller 40 passes between the thickness regulating blade 41 and the developing roller 40, where the toner is even further tribocharged, while being regulated to a toner layer of a predetermined thin thickness on the developing roller 40.

As the photosensitive drum 31 rotates, first the charger 32 applies a uniform charge of positive polarity across the surface of the photosensitive drum 31. Subsequently, the surface of the photosensitive drum 31 is exposed by the high-scanning of the laser beam L emitted from the scanner unit 27. As a result, electrostatic latent images are formed on the surface of the photosensitive drum 31.

When the positively charged toner carried on the surface of the developing roller 40 opposes and contacts the. photosensitive drum,31 as the developing roller 40 rotates, the toner is selectively supplied to the electrostatic latent images on the photosensitive drum 31. As a result, the electrostatic latent images on the photosensitive drum 31 are transformed into visible toner images. In this way, a reverse development is performed.

The belt unit 15 is disposed beneath the process unit 25 and includes a pair of support rollers 16 and 17 separated from each other in the front-to-rear direction, the conveying belt 18 looped around the support rollers 16 and 17 so as to extend horizontally, and a metal backup roller 22. The belt unit 15 is detachably mounted in the main casing 2.

The support roller 17 disposed on the rear side of the support roller 16 is a drive roller that is driven to rotate by a driving force inputted from a motor (not shown). The support roller 16 disposed on the front side is a tension roller for applying tension to the conveying belt 18. The conveying belt 18 is an endless belt formed of a synthetic resin material, such as polycarbonate. When the support roller 17 is driven to rotate, the conveying belt 18 moves circuitously in a counterclockwise direction in FIG. 1 for conveying a sheet of the paper 4 resting on the top surface of the conveying belt 18 rearward. Four transfer rollers 19 are arranged at regular intervals in the front-to-rear direction inside the conveying belt 18 and are positioned opposite each of the photosensitive drums 31 so that the conveying belt 18 is interposed between the transfer rollers 19 and the respective photosensitive drums 31. During a transfer operation, a transfer bias is applied between the transfer rollers 19 and the photosensitive drums 31. When the belt unit 15 is mounted in the main casing 2, the support roller 17 is engaged with a gear mechanism (not shown) provided in the main casing 2 and is driven to rotate by the driving force of the motor provided in the main casing 2 that is transmitted via the gear mechanism.

The toner image borne on the surface of each photosensitive drum 31 is transferred onto the paper 4 by a negative transfer bias applied to the transfer roller 19, as the paper 4 on the conveying belt 18 passes through a transfer position between the photosensitive drum 31 and the transfer roller 19. The paper 4 with the toner images is conveyed to a fixing unit 43.

The fixing unit 43 is disposed on the rear side of the conveying belt 18 within the main casing 2, and includes a heat roller 44, which is a driving roller, and a pressing roller 45, which is a driven roller. Although not shown in the drawings, the heat roller 44 includes a heat source, such as a halogen lamp. The pressing roller 45 is disposed in pressed contact with the heat roller 44.

In the fixing unit 43, toner images of four colors are thermally fixed onto the paper 4 as the paper 4 is conveyed between the heat roller 44 and the pressing roller 45. Afterward, the paper 4 with the toner images fixed thereon is conveyed by a conveying roller 46 disposed diagonally above and rearward of the fixing unit 43 to discharge rollers 47 disposed in the upper section of the main casing 2. Then, the discharge rollers 47 discharge the paper 4 onto the discharge tray 5.

A cleaning roller 21 is disposed below the belt unit 15 for removing toner, paper dust, and the like clinging to the conveying belt 18. The cleaning roller 21 includes a metal shaft coated with a foamed material made of silicon, and is in confrontation with the backup roller 22 with the conveying belt 18 interposed therebetween.

A prescribed bias is applied between the cleaning roller 21 and the backup roller 22 for electrically attracting toner and the like carried on the surface of the conveying belt 18 toward the cleaning roller 21. A metal collecting roller 23 is disposed in contact with the cleaning roller 21 for removing toner and the like deposited on the surface of the cleaning roller 21. Further, a blade 24 is disposed in contact with the collecting roller 23 for scraping off toner and the like carried on the surface of the collecting roller 23.

The construction for removing paper dust deposited on the paper 4 will be described next. In the laser printer 1, such a construction is provided on the front cover 3 and inside the main casing 2 (here, the structure of the front cover 3 is not included in the interior of the main casing 2).

The structure of the front cover 3 will be described first. As shown in FIG. 1, the front cover 3 includes a main cover body 95 that blocks the access opening 2A of the main casing 2, a pair of left and right joining parts 96 protruding from both side edges of the main cover body 95, and a mounting shaft 3A disposed on the lower edges of the joining parts 96. The mounting shaft 3A is attached to a position near the lower edge of the main casing 2 on the front surface thereof so that the front cover 3 can pivot about the mounting shaft 3A. The front cover 3 is capable of pivoting between a closed position shown in FIG. 1 closed over the access opening 2A, and an open position shown in FIG. 2 pivoted forward 90 degrees from the closed position (so that the front surface of the main cover body 95 is horizontal) for exposing the access opening 2A.

Figure 7:
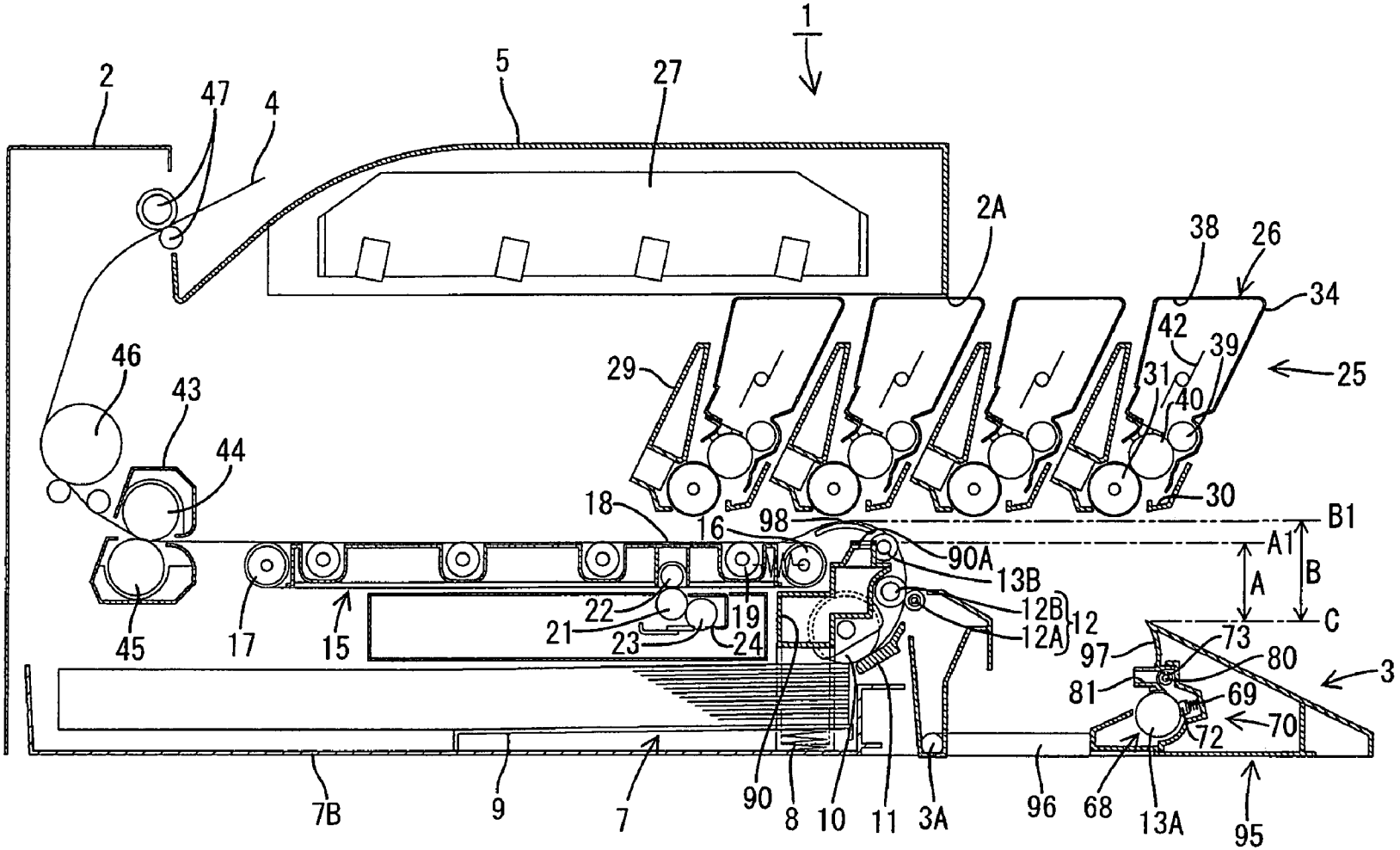
FIG. 7 is a side cross-sectional view of the laser printer when the process unit is partially removed.

By opening the front cover 3, as shown in FIG. 7, it is possible to replace (remove and mount) the process unit 25 and the belt unit 15 in the main casing 2 or to remove paper 4 that has become jammed inside the main casing 2.

The main cover body 95 has a substantially triangular cross-section that increases in thickness toward the bottom. The registration roller 13A is mounted in the bottom end of the main cover body 95. A cover-side guide part 97 is formed integrally with the bottom surface of the main cover body 95 downstream (rearward) of the registration roller 13A in the paper-conveying direction. The cover-side guide part 97 has a concave arc-shaped surface to correspond to the shape of the main-casing-side guide part 98. When the front cover 3 is closed, the gap between the main-casing-side guide part 98 and the cover-side guide part 97 forms a paper-conveying path along which the paper 4 is conveyed.

Hence, the paper 4 conveyed by the registration rollers 13 is guided along the cover-side guide part 97 and the main-casing-side guide part 98 so as to contact the top surface of the conveying belt 18 near the front edge thereof at an angle sloping downward.

Here, the paper 4 is guided onto the conveying belt 18 at an angle because there is potential for the paper 4 to float off the surface of the conveying belt 18 if the paper 4 were to contact the surface of the conveying belt 18 while moving in a direction parallel to the surface. However, by guiding the paper 4 onto the surface of the conveying belt 18 at an angle, the paper 4 is pressed against the surface, ensuring that the paper 4 remains in contact with the surface of the conveying belt 18.

An accommodating chamber 68 is formed substantially in the lower half of the main cover body 95 for accommodating a paper dust removing unit 70 and an auger member 80 described below.

The paper dust removing unit 70 functions to remove paper dust deposited on the paper 4. The paper dust removing unit 70 includes the registration roller 13A, a sponge member 72, a paper dust receiving section 73, and an elastic member 69. The registration roller 13A functions as the paper dust removing roller for attracting paper dust deposited on the paper 4 to the surface of the registration roller 13A as the paper 4 is conveyed by the registration roller 13A. The sponge member 72 is for scraping paper dust off the surface of the registration roller 13A. The paper dust receiving section 73 is for receiving paper dust scraped off by the sponge member 72. The elastic member 69 is a spring, for example.

The registration roller 13A has a metal roller shaft that is oriented parallel to the mounting shaft 3A of the front cover 3. The portion of the peripheral surface of the registration roller 13A opposing the registration roller 13B supported on the main casing 2 is exposed out of the accommodating chamber 68. The surface of the registration roller 13A is formed of a fluorocarbon resin that readily charges. As the registration roller 13A rotates and contacts the sponge member 72 with friction, an static charge is produced on the surface of the registration roller 13A. This static charge attracts paper dust from the paper 4.

The roller shaft of the registration roller 13A is supported in a support member (not shown) of the main cover body 95. When the front cover 3 is closed, a motor (not shown) operating at a prescribed timing supplies a driving force via a gear mechanism linked to the registration roller 13A for rotating the registration roller 13A in the clockwise direction in FIG. 1. The same motor also drives the registration roller 13B in the main casing 2 to rotate counterclockwise in FIG. 1 so that a sheet of paper 4 interposed between the registration rollers 13A and 13B is conveyed at a prescribed timing.

The sponge member 72 is configured of urethane foam or the like in the shape of a rectangular parallelepiped. One surface of the sponge member 72 is connected to an upper wall in the accommodating chamber 68 via the elastic member 69. The elastic force of the elastic member 69 urges the sponge member 72 to contact the surface of the registration roller 13A. The paper dust receiving section 73 is an arc-shaped depression extending along the entire width of the paper-conveying path.

Figure 6:
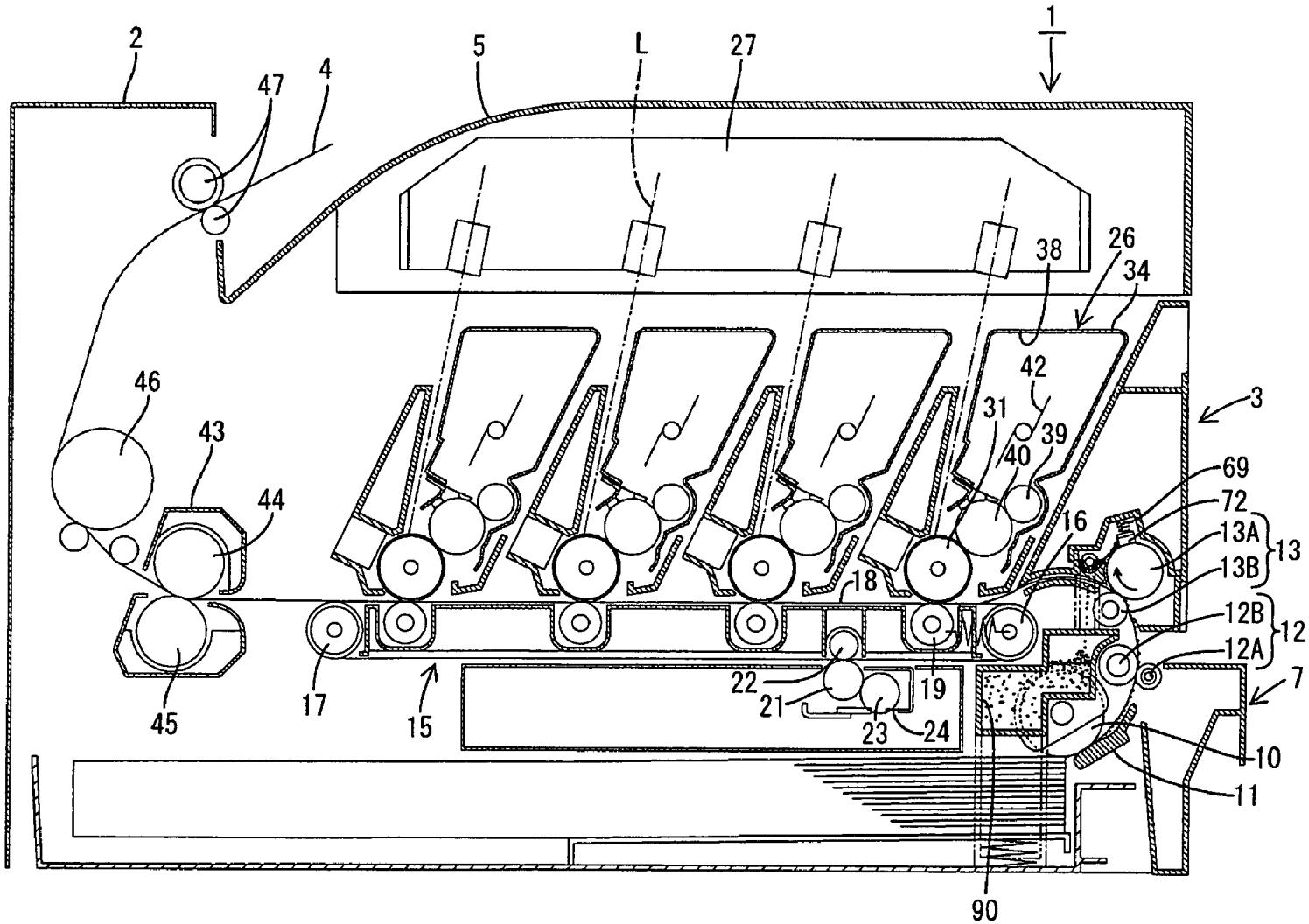
FIG. 6 is an explanatory diagram illustrating the removal of paper dust from paper.

With this construction, when the registration roller 13A rotates in the clockwise direction, the sponge member 72 scrapes off paper dust from the surface of the registration roller 13A, the paper dust builds up into clumps and falls into the paper dust receiving section 73 (see FIG. 6).

Figure 4:
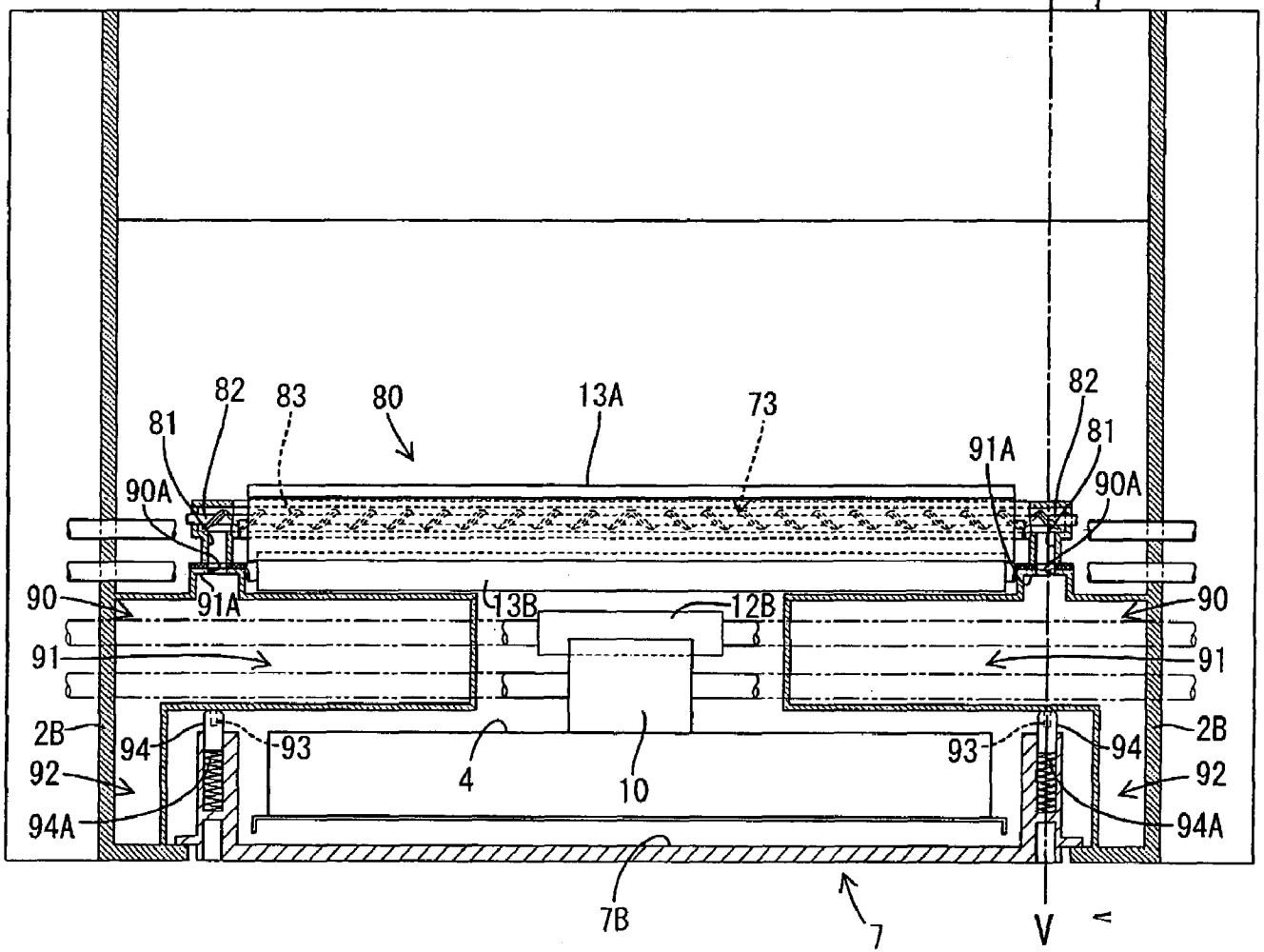
FIG. 4 is a front cross-sectional view of the laser printer in FIG. 1.

The auger member 80 is provided inside the paper dust receiving section 73 across the entire width thereof. As shown in FIG. 4, the auger member 80 is integrally formed of a shaft member 82 and a spiral part 83 formed around the shaft member 82. An auger drive gear (not shown) is provided on one end of the shaft member 82 for inputting a driving force from a motor (not shown). The driving force inputted from the motor drives the auger member 80 to rotate.

The spiral part 83 spirals around the shaft member 82 in different directions on either side of an approximate center point so that the spiral part 83 can convey paper dust in different directions. Hence, when the auger member 80 is rotated in a prescribed direction, the paper dust inside the paper dust receiving section 73 is conveyed to the nearest end of the auger member 80.

Paper dust passages 81 are also formed in the front cover 3 in communication with the paper dust receiving section 73 (FIG. 1) on the widthwise sides of the paper conveying direction. The paper dust passages 81 are vertically oriented tube-shaped members having a sufficient diameter to allow the passage of paper dust. Therefore, paper dust conveyed by the auger member 80 to both widthwise ends in the main casing 2 falls through the paper dust passages 81.

The structure inside the main casing 2 will be described next. As shown in FIG. 4, a pair of paper dust collecting vessels 90 is provided inside the main casing 2, one at either widthwise end of the paper-conveying path. The paper dust collecting vessels 90 have space for accommodating paper dust that falls through the paper dust passages 81.

Note that if the paper dust collecting vessels 90 are disposed above the paper-conveying path, for example, there is generally little space for accommodating the paper dust collecting vessels 90. However, the paper dust collecting vessels 90 of the laser printer 1 according to the illustrative aspects are disposed to a relatively large space outside the paper-conveying path.

Each of the paper dust collecting vessels 90 includes a first storage part 91 and a second storage part 92, both shaped substantially like rectangular parallelepipeds. The first storage part 91 is provided between the belt unit 15 (FIG. 1) and the sheet supply cassette 7, and beneath the paper-conveying path. The second storage part 92 is disposed between the sheet supply cassette 7 and a side wall 2B of the main casing 2 and is in communication with the first storage part 91.

A protruding part 91A protrudes upward from the top surface of each first storage part 91. A through-hole 90A vertically penetrates the center region of each protruding part 91A. When the front cover 3 is in a closed state, the through-holes 90A are in communication with the paper dust passages 81, allowing paper dust passing through (falling through) the paper dust passages 81 to collect in the first storage parts 91 and the second storage parts 92.

As described above, the first storage parts 91 of the paper dust collecting vessels 90 are disposed between the belt unit 15 and the sheet supply cassette 7 in a space below the paper-conveying path. Accordingly, this configuration not only effectively uses space below the paper-conveying path, but also ensures sufficient capacity for accommodating paper dust. Further, the paper dust can be accumulated naturally, rather than going against gravity.

This construction also makes effective use of space on the side of the sheet supply cassette 7 by disposing the second storage part 92 of the paper dust collecting vessels 90 between the sheet supply cassette 7 and the side wall 2B of the main casing 2.

Figure 5:
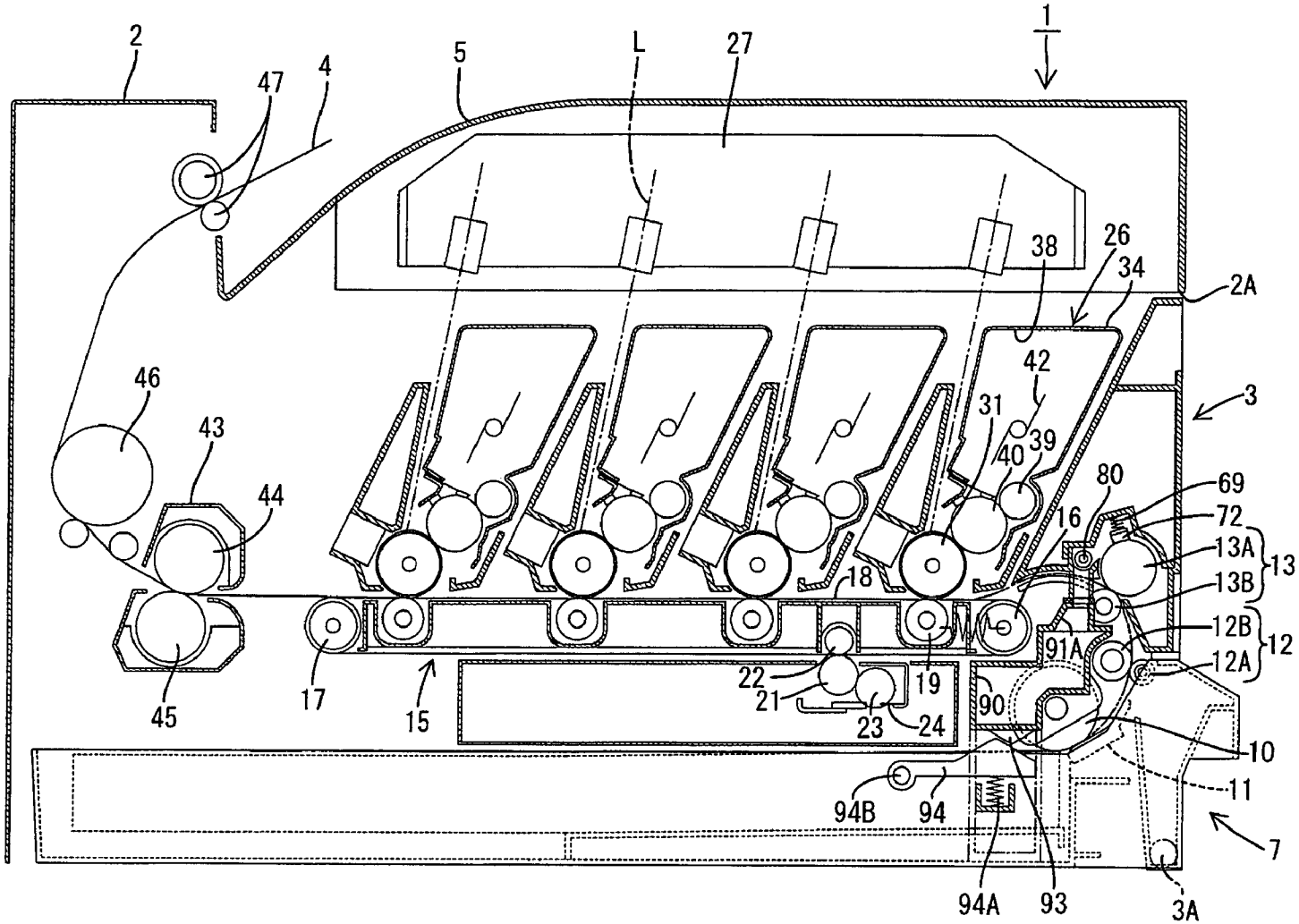
FIG. 5 is a side cross-sectional view showing the structure of the laser printer taken along a line V-V in FIG. 4.

As shown in FIGS. 4 and 5, a protrusion 93 is provided on the bottom wall of each first storage part 91 and protrudes downward from the lower surface of the bottom wall. An interference part 94 is provided on the upper portion of each side wall of the sheet supply cassette 7 and has a chevron-shaped protrusion on the top surface thereof. The interference part 94 is pivotably supported at one end by a shaft 94B. An elastic member 94A, such as a spring, is disposed on the underside surface of the interference part 94 for urging the interference part 94 upward. When the sheet supply cassette 7 is pulled outward or inserted inward of the main casing 2, the interference part 94 interferes with the protrusion 93 as the interference part 94 is urged by the elastic force of the elastic member, applying a vibration to the paper dust collecting vessels 90. This vibration has the effect of gradually evening the level of paper dust in the, first storage part 91 that has fallen through the through-hole 90A almost directly downward so that paper dust can more easily be stored in the second storage part 92 and the effect of reducing unevenness in the accumulated paper dust.

The pair of registration rollers 13 described earlier together with the cover-side guide part 97 and the main-casing-side guide part 98 constitute a feeding unit 50 shown in FIG. 1. As described earlier, after correcting skew in the paper 4 supplied from the sheet supply rollers 12, the registration rollers 13 convey the paper 4 downstream (rearward) at a prescribed timing. At this time, the cover-side guide part 97 and the main-casing-side guide part 98 guide the paper 4 onto the conveying belt 18 in the belt unit 15.

If a paper jam occurs in the laser printer 1 during a printing operation, the operator can pull the front cover 3 forward from the closed position to the open position. Through this operation, the registration roller 13A and the cover-side guide part 97 of the feeding unit 50 move together with the front cover 3 and separate from the registration roller 13B and the main-casing-side guide part 98, respectively, thereby exposing the paper-conveying path. In this way, the paper-conveying path can be exposed by opening a portion of the feeding unit 50 together with the front cover 3, thereby facilitating an operation to resolve a paper jam.

As described above, the paper dust removing unit 70 and the auger member 80 are provided on the front cover 3 so as to be capable of moving together with the front cover 3 when the front cover 3 is opened. Hence, the paper dust removing unit 70 and the auger member 80 are not in the way when clearing a paper jam in the main casing 2, unlike when the paper dust removing unit 70 is fixed inside the main casing 2, thereby facilitating the resolution of paper jams. Further, since paper dust and other deposited matter is collected in the paper dust collecting vessels 90 provided inside the main casing 2, the paper dust collecting vessels 90 can more easily be provided with the required capacity for collecting paper dust than when provided on the front cover 3. Further, since paper dust is collected in the paper dust collecting vessels 90 provided inside the main casing 2, paper dust is less likely to scatter when the front cover 3 is opened than when the paper dust collecting vessels 90 are provided to the front cover 3.

The registration roller 13A functions to remove paper dust from the paper 4. This construction minimizes the number of required rollers, thereby making the laser printer 1 simpler and more compact.

Next, the mounting and removal operation for the process unit 25 and the belt unit 15 will be described. When mounting or removing the process unit 25 and the belt unit 15, the operator pulls the process unit 25 forward when the front cover 3 is in the open position shown in FIG. 2. When pulled at this time, the process unit 25 moves diagonally upward along guiding means (not shown) provided in the main casing 2. Since the photosensitive drums 31 in the process unit 25 separate from the conveying belt 18 through this operation, the process unit 25 can be smoothly pulled out of the main casing 2, without the photosensitive drums 31 sliding in contact with the conveying belt 18. At this time, the process unit 25 is raised so that the bottom end of the process unit 25 (i.e., the bottom edges of the photosensitive drums 31) is positioned slightly higher than the height B1 to the top edge of the main-casing-side guide part 98. Subsequently, the process unit 25 is pulled forward in the horizontal direction while maintained at this height (see FIG. 7). At this time, as shown in FIG. 7, the highest edge of the front cover 3 in the open position has a height C, which is lower than the height B1 by a distance B, thereby preventing the front cover 3 from interfering with the process unit 25.

Hence, this construction not only prevents the front cover 3 from interfering with the process unit 25 when the process unit 25 is removed through the access opening 2A of the main casing 2, but facilitates operations to resolve paper jams.

After removing the process unit 25 from the main casing 2 in this way, the developing cartridges 34 become accessible and can be replaced outside the main casing 2.

It should be noted that if the topmost edge of the front cover 3 in the open state were positioned higher than the feeding unit 50 (i.e., the main-casing-side guide part 98), as in the example indicated by a broken line in FIG. 2, the process unit 25 would have to be lifted to a position higher than the topmost edge of the front cover 3 when removing the process unit 25 in order to avoid interference with the front cover 3. This would require additional space inside the main casing 2 to allow passage of the process unit 25, thereby leading to a larger device. However, since the topmost edge of the front cover 3 in the open state is positioned lower than the main-casing-side guide part 98, there is no need to lift the process unit 25 higher to avoid interference with the main-casing-side guide part 98, thereby contributing to a more compact device.

Figure 8:
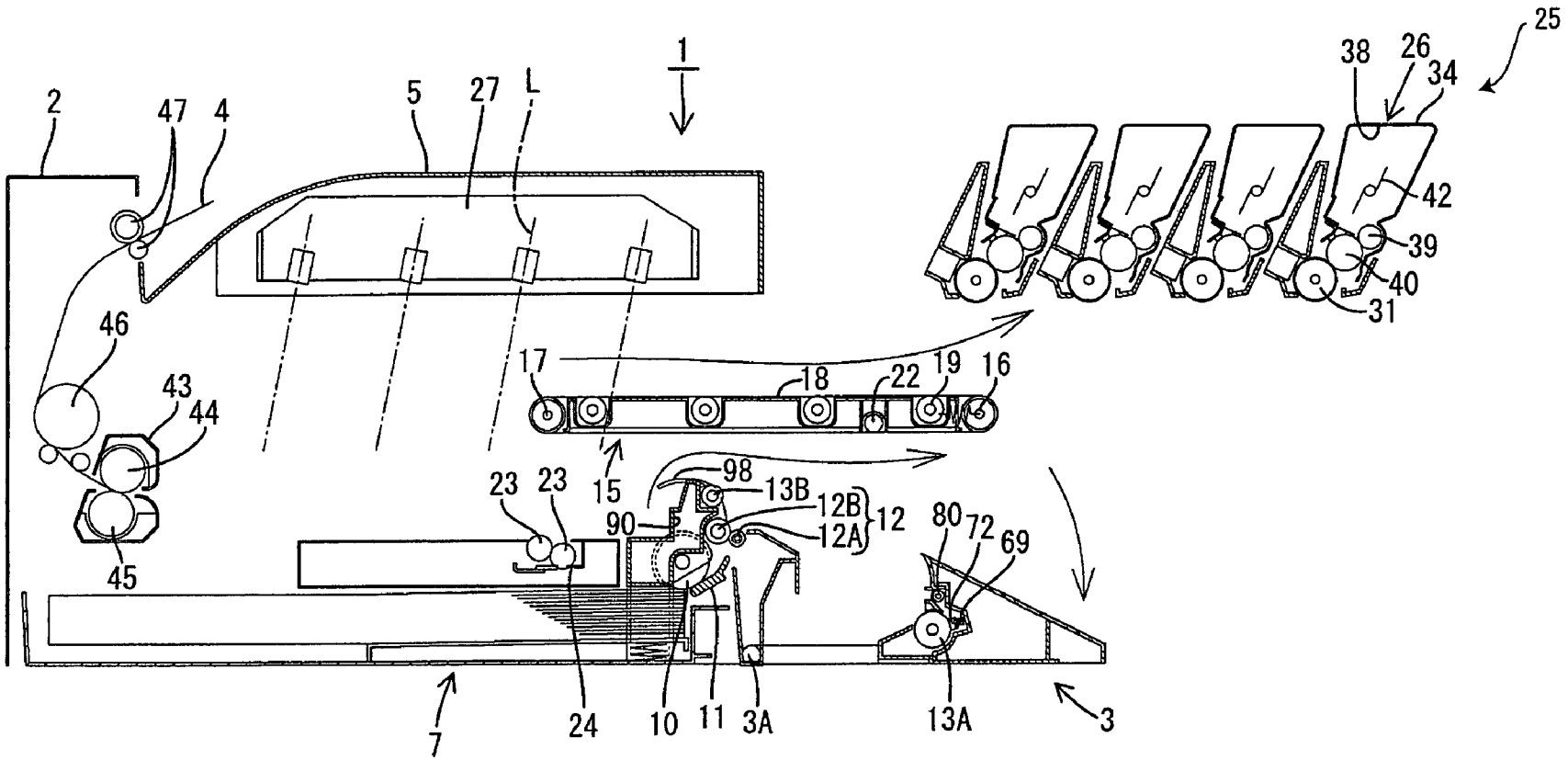
FIG. 8 is an explanatory diagram illustrating the removal of a belt unit of the laser printer in FIG. 1.

Note that it is possible to change the open position of the front cover 3 to a prescribed angle (a position slightly lower than the position indicated by the broken line in FIG. 2), such that at least a portion of the cover-side guide part 97 is lower than the height B1 of the main-casing-side guide part 98. Further, if the main-casing-side guide part 98 in the main casing 2 does not expand upward, the height C to the topmost edge of the front cover 3 in the open position may be set to a height at least lower than the height of the main-casing-side guide part 98. For example, if the height of the main-casing-side guide part 98 and the height to the top surface of the conveying belt 18 are both the height A1, the height C to the uppermost edge of the front cover 3 in the open position or at least a portion of the cover-side guide part 97 should be lower than the height A1 to the top surface of the conveying belt 18. (The height C is lower than the height Al by a distance A in FIG. 2.) In order to replace the belt unit 15, as shown in FIG. 8, the process unit 25 is first removed from the main casing 2, as described above, and the belt unit 15 is subsequently removed through the access opening 2A.

Next, a laser printer 201 according to second illustrative aspects of the invention will be described with reference to FIGS. 9 and 10. In the following description, like parts and components with those in the first embodiment are designated with the same reference numerals to avoid duplicating description.

Figure 9:
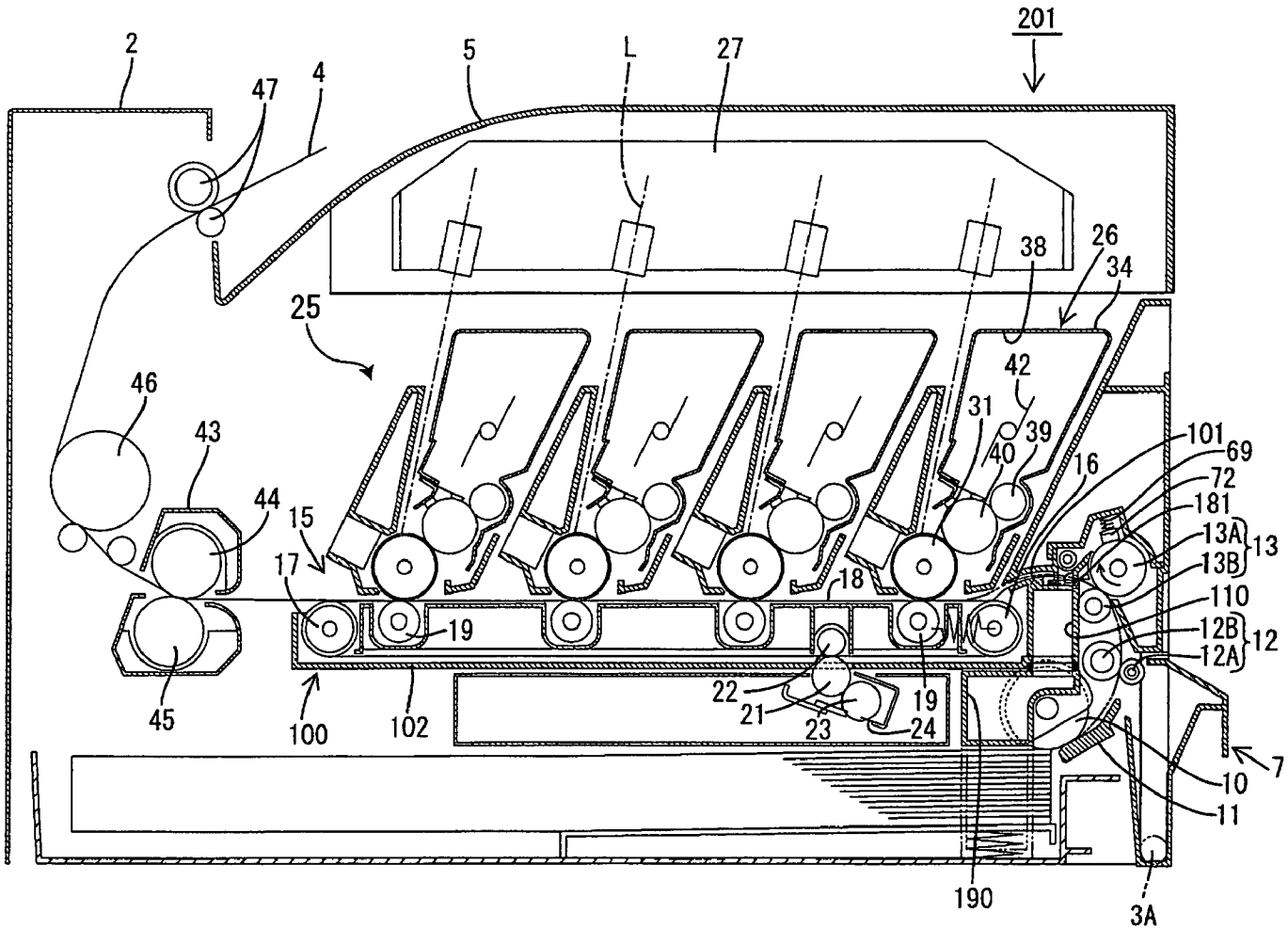
FIG. 9 is a side cross-sectional view of a laser printer according to second illustrative aspects of the invention.

Unlike the above-described laser printer 1, the laser printer 201 according to the second illustrative aspects has a belt unit case 100 for accommodating the belt unit 15, as shown in FIG. 9. With this construction, the belt unit 15 is mounted and removed together with the belt unit case 100.

Figure 10:
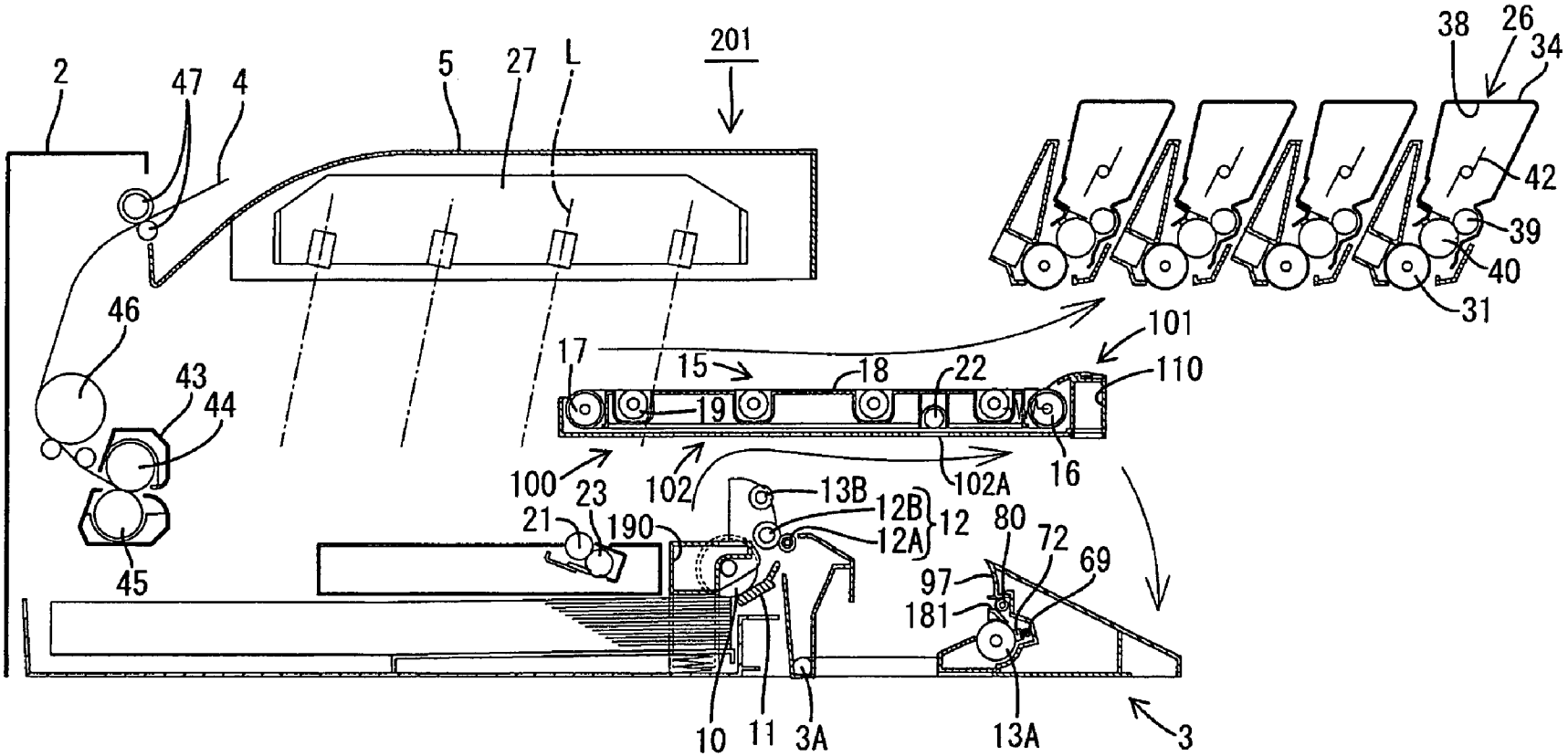
FIG. 10 is an explanatory diagram illustrating the removal of a belt unit of the laser printer in FIG. 9.

As shown in FIG. 10, the belt unit case 100 is integrally configured of a belt unit accommodating section 102 capable of accommodating the entire belt unit 15, and a guide member 101 for guiding-the paper 4.

The belt unit accommodating section 102 has a box shape and is slightly larger than the belt unit 15. A through-hole 102A is formed in the bottom surface of the belt unit accommodating section 102 so that the backup roller 22 confronts and contacts the cleaning roller 21 via the conveying belt 18.

The guide member 101 is disposed on the front end of the belt unit case 100. The guide member 101 functions to guide the paper 4 fed by the pickup roller 10 onto the conveying belt 18 in the same manner as the main-casing-side guide part 98 of the above-described laser printer 1. Note that the main-casing-side guide part 98 is dispensed with in the laser printer 201 of the second illustrative aspects.

Paper dust through-holes 110 (only one is shown in FIGS. 9 and 10) are formed through the guide member 101 on both widthwise ends of the paper-conveying path. Paper dust passages 181 (only one is shown in FIGS. 9 and 10) are formed in the front cover 3 for allowing the passage of paper dust. Paper dust that falls through the paper dust passages 181 passes through the paper dust through-holes 110 formed in the guide member 101 and accumulates in paper dust collecting vessels 190.

In order to remove the belt unit 15, the operator first opens the front cover 3 and removes the process unit 25 through the access opening 2A, as shown in FIG. 10. Next, while the process unit 25 is removed from the main casing 2, the operator grips the guide member 101 and lifts the belt unit case 100 slightly to disengage shaft receiving parts (not shown) supporting the shafts of the support rollers 16 and 17 from positioning members (not shown) provided in the main casing 2 and functioning to position the shaft receiving parts. At this time, the belt unit case 100 and the belt unit 15 are removed integrally through the access opening 2A of the main casing 2.

With this construction, paper dust removed from the paper 4 passes through the paper dust through-holes 110 and collects in the paper dust collecting vessels 190 disposed below the belt unit 15.

Figure 11:
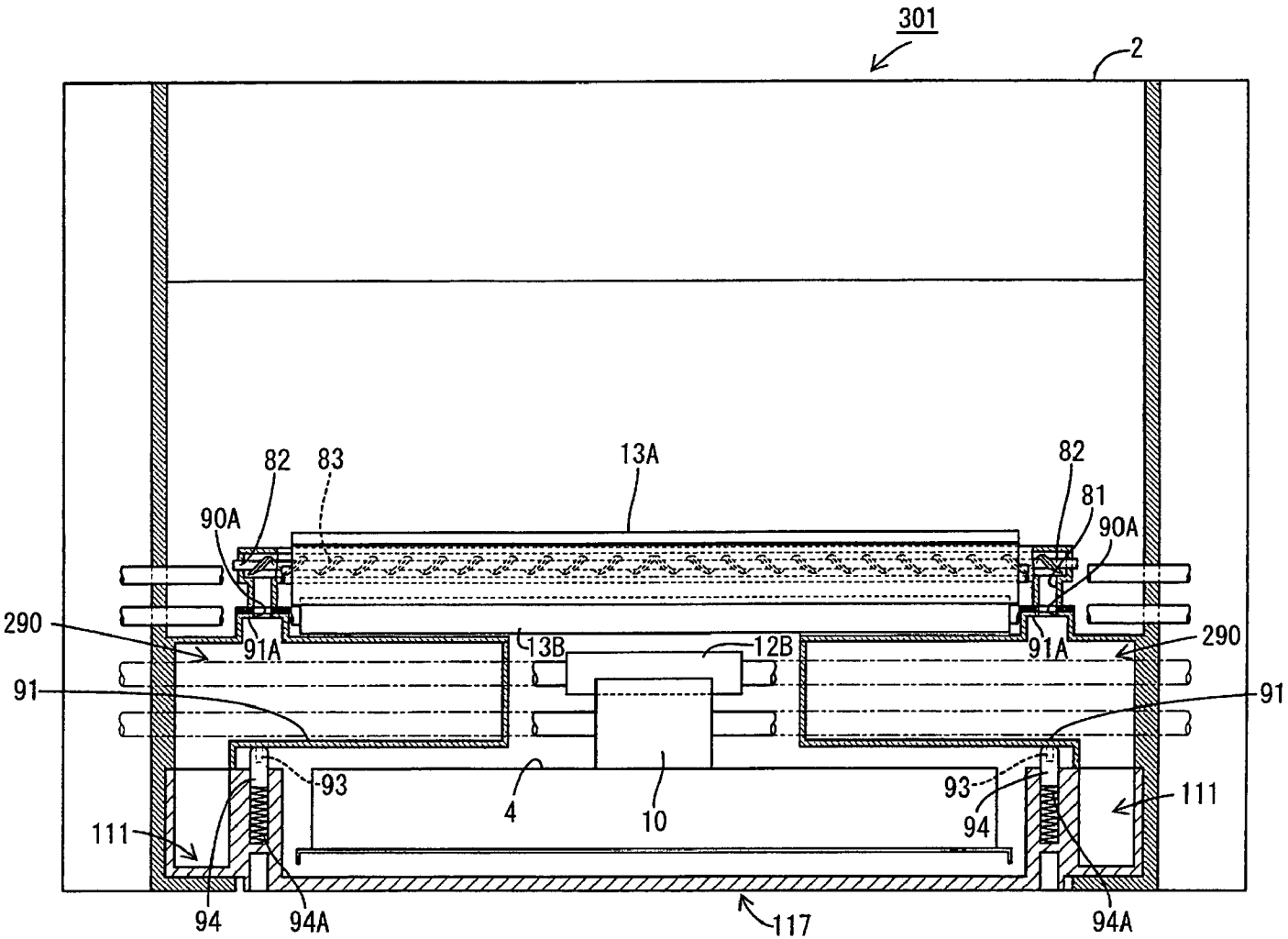
FIG. 11 is a front cross-sectional view of a laser printer according to third illustrative aspects of the invention.

Next, a laser printer 301 according to third illustrative aspects of the invention will be described with reference to FIG. 11. In the following description, like parts and components with those in the first illustrative aspects are designated with the same reference numerals to avoid duplicating description.

In the above-described laser printer 1, the second storage parts 92 of the paper dust collecting vessels 90 are provided in gaps formed between the sheet supply cassette 7 and the side walls 2B of the main casing 2. However, as shown in FIG. 11, the laser printer 301 according to the third illustrative aspects has a sheet supply cassette 117 that is wider than the sheet supply cassette 7 of the above-described laser printer 1, and second storage parts 111 of paper dust collecting vessels 290 are provided in the sheet supply cassette 117 on either side of the paper 4, that is, in the ends of the sheet supply cassette 117 not occupied by the paper 4. Accordingly, this construction not only effectively uses space inside the sheet supply cassette 117, but also enables the removal of paper dust when the sheet supply cassette 117 is pulled out of the main casing 2.

While the invention has been described in detail with reference to the above aspects thereof, it would be apparent to those skilled in the art that various changes and modifications may be made therein without departing from the spirit of the invention.

For example, in the above aspects, the interference parts 94 provided on the sheet supply cassette 7 are configured to interfere with the paper dust collecting vessels 90. However, another structure may be employed to apply vibrations to the paper dust collecting vessels 90, such as a structure that disposes the interference parts 94 on the paper dust collecting vessels 90.

Also, in the above aspects, paper dust is collected in the paper dust collecting vessels 90. However, the laser printer may be configured to collect paper dust with a container having another shape and the like.

Further, the invention may also be applied to a device employing two colors of toner, such as red and black, or six colors of toner.

Moreover, the feeding unit 50 may also include a sensor for detecting the position of the paper, ribs for guiding the paper, and the like.

What is claimed is:

1. An image-forming device comprising:

a main casing having a surface formed with an opening;

a process unit having a plurality of image-forming units that forms images on a recording medium, the process unit being horizontally attachable to and detachable from the main casing through the opening;

a conveying belt that is disposed below the process unit and conveys the recording medium;

a feeding unit that is disposed between the opening and the conveying belt and includes a first part and a second part opposing the first part, wherein the feeding unit feeds the recording medium between the first part and the second part onto the conveying belt; and a cover capable of opening and closing over the opening, wherein:

the first part of the feeding unit is displaceable together with the cover; and an upper edge of the cover in an open state is positioned lower than an upper end of the second part of the feeding unit.

2. The image-forming device according to claim 1, wherein the feeding unit feeds the recording medium such that the recording medium contacts a top surface of the conveying belt at a downward sloping angle.

3. The image-forming device according to claim 1, wherein: the first part and the second part of the feeding unit have respective arc-shaped surfaces that oppose each other; the feeding unit further includes a pair of conveying rollers that pinches and conveys the recording medium; and one of the conveying rollers is retained on the cover and displaceable together with the cover.

4. The image-forming device according to claim 1, wherein the second part of the feeding unit is formed on the main casing.

5. The image-forming device according to claim 1, further comprising: a deposition removing unit that is disposed on the cover and on a conveying path along which the recording medium is conveyed in a conveying direction, the deposition removing unit removing matter deposited on the recording medium; and a deposition collecting unit that is disposed inside the main casing and collects the matter removed by the deposition removing unit.

6. The image-forming device according to claim 5, further comprising a deposition conveying unit that is disposed on the cover and conveys the matter removed by the deposition removing unit to a region outside the conveying path with respect to a direction orthogonal to the conveying direction, wherein the matter conveyed by the deposition conveying unit is collected in the deposition collecting unit.

7. The image-forming device according to claim 5, wherein the deposition collecting unit includes a deposition-collecting vessel that accommodates the matter, and the deposition-collecting vessel is disposed beneath the conveying path.

8. The image-forming device according to claim 5, further comprising a cassette that is attachable to and detachable from the main casing and accommodates the recording medium, wherein the deposition collecting unit includes a deposition-collecting vessel that accommodates the matter, and one of the cassette and the deposition-collecting vessel has an interference part that interferes with the other of the cassette and the deposition-collecting vessel when the cassette is attachable to and detachable from the main casing.

9. The image-forming device according to claim 8, further comprising an elastic member that urges the interference part, wherein: the interference part is provided on the cassette; the deposition-collecting vessel has a bottom surface formed with a protruding part; and the interference part urged by an elastic force of the elastic member interferes with the protruding part when the cassette is attachable to and detachable from the main casing.

10. The image-forming device according to claim 8, further comprising a guide roller disposed in the cassette along the conveying path, the guide roller guiding the recording medium along the conveying path.

11. The image-forming device according to claim 8, wherein a portion of the deposition collecting unit is disposed on a side of the cassette with respect to a direction orthogonal to the conveying direction.

12. The image-forming device according to claim 8, wherein a portion of the deposition collecting unit is disposed in the cassette on a side of the conveying path with respect to a direction orthogonal to the conveying direction.

13. The image-forming device according to claim 5, further comprising a belt unit including the conveying belt, wherein: the deposition collecting unit is disposed below the belt unit; the belt unit is disposed downstream of the deposition removing unit in the conveying direction; and the belt unit is formed with through-holes vertically penetrating ends of the belt unit with respect to a direction orthogonal to the conveying direction, the through-holes enabling the matter removed by the deposition removing unit to pass through the belt unit and be collected in the deposition collecting unit.

14. The image-forming device according to claim 13, wherein the second part of the feeding unit is formed on the belt unit.

15. The image-forming device according to claim 5, further comprising an opposition roller, wherein the deposition removing unit includes a deposition-removing roller that removes the matter deposited on the surface of the recording medium, the deposition-removing roller opposing the opposition roller, wherein the opposition roller and the deposition-removing roller are registration rollers that perform registration on the recording medium.

16. The image-forming device according to claim 5, wherein the deposition removing unit is displaceable together with the cover.

17. An image-forming device comprising:

a main casing having a surface formed with an opening;

a process unit having a plurality of image-forming units that forms images on a recording medium positioned within the main casing;

a conveying belt that is disposed below the process unit and conveys the recording medium;

a cover capable of opening and closing over the opening; a deposition removing unit that is disposed on the cover and removes matter deposited on a recording medium; and a deposition collecting unit that is disposed inside the main casing and collects the matter removed by the deposition removing unit.

18. The image forming device of claim 17, further comprising a feeding unit that is disposed between the opening and the conveying belt and includes a first part and a second part opposing the first part, wherein the feeding unit feeds the recording medium between the first part and the second part onto the conveying belt.

19. An image-forming device comprising:

a main casing having a surface formed with an opening;

a pickup roller;

a pair of registration rollers positioned downstream of the pickup roller;

a recording medium path along which a recording medium is conveyed, the recording medium path beginning at the pickup roller;

a cover capable of opening and closing over the opening; a deposition removing unit that is disposed on the cover and removes matter deposited on the recording medium; and a deposition collecting unit that is disposed inside the main casing and collects the matter removed by the deposition removing unit;

wherein the recording medium path downstream of the registration rollers extends between the deposition removing unit and the deposition collecting unit.

20. The image forming device of claim 19, further comprising:

a feeding unit that is disposed between the opening and the conveying belt and includes a first part and a second part opposing the first part, wherein the feeding unit feeds the recording medium between the first part and the second part onto the conveying belt; and a process unit having a plurality of image-forming units that forms images on the recording medium positioned within the main casing.

* * * * *